US010847124B1

(12) United States Patent
McGuire

(10) Patent No.: US 10,847,124 B1
(45) Date of Patent: Nov. 24, 2020

(54) GUITAR NECK ASSEMBLY

(71) Applicant: Edwin McGuire, Watauga, TX (US)

(72) Inventor: Edwin McGuire, Watauga, TX (US)

( * ) Notice: Subject to any disclaimer, the term of this patent is extended or adjusted under 35 U.S.C. 154(b) by 149 days.

(21) Appl. No.: 16/012,474

(22) Filed: Jun. 19, 2018

(51) Int. Cl.

| | |
|---|---|
| ***G10D 3/00*** | (2020.01) |
| ***G10D 3/06*** | (2020.01) |
| ***G10D 3/10*** | (2006.01) |
| ***G10D 3/04*** | (2020.01) |
| ***G10D 1/08*** | (2006.01) |

(52) U.S. Cl.
CPC ..... *G10D 3/06* (2013.01); *G10D 1/08* (2013.01); *G10D 3/04* (2013.01); *G10D 3/10* (2013.01)

(58) Field of Classification Search
CPC .. G10D 3/06; G10D 1/08; G10D 3/04; G10D 3/10
USPC ..... 84/291; D17/20
See application file for complete search history.

(56) References Cited

U.S. PATENT DOCUMENTS

| | | | | |
|---|---|---|---|---|
| 375,224 | A | 12/1887 | Talbott | |
| 860,137 | A | 7/1907 | Inskeep | |
| 1,183,369 | A | 5/1916 | Gardie | |
| 1,304,914 | A | 5/1919 | Smith | |
| 1,707,115 | A * | 3/1929 | Dierdorf | G10H 3/185 84/723 |
| 1,752,906 | A | 4/1930 | Hillebrandt | |
| 2,572,207 | A | 10/1951 | Shirley | |
| 3,188,902 | A | 6/1965 | Levasseur | |
| 4,242,938 | A | 1/1981 | Van Zalinge | |
| 4,467,692 | A | 8/1984 | Egan | |
| 4,539,886 | A | 9/1985 | Hoffart | |
| 4,646,613 | A | 3/1987 | Banchetti | |
| 4,686,882 | A * | 8/1987 | Shaw | G10D 1/08 84/291 |
| 4,903,567 | A | 2/1990 | Justus | |
| 5,229,537 | A * | 7/1993 | Kennedy | G10H 3/185 84/727 |
| 5,537,906 | A | 6/1996 | Steinberger | |
| 6,005,173 | A | 12/1999 | Mitchell | |
| 6,087,569 | A | 7/2000 | Gottschall | |
| 7,342,158 | B2 | 3/2008 | Olson | |
| 7,425,671 | B2 | 9/2008 | Cupit | |
| 7,482,519 | B2 | 1/2009 | Linden et al. | |
| 8,461,441 | B2 | 6/2013 | Miloslavsky | |
| 9,412,343 | B2 | 8/2016 | Shankar | |

* cited by examiner

*Primary Examiner* — Jianchun Qin
(74) *Attorney, Agent, or Firm* — Law Office of Jeff Williams PLLC; J. Oliver Williams

(57) ABSTRACT

A musical instrument neck assembly includes a neck body with a top portion and a tail portion. A finger board is located adjacent the top portion. A plurality of strings are strung the length of the neck body extending from a head at the top portion and coupled to the bottom end of the neck body at the tail portion. The assembly includes a bridge and a hollowed body. Both are separate from the anchors of the plurality of strings. The bridge is nestled below the finger board and rests directly on the hollowed body. The hollow body and the bridge rest on top of the neck body and are made of a material of suitable strength and acoustic properties to support the lateral tension forces of the plurality of strings spanning from the top portion of the neck body to the tail portion of the neck body.

18 Claims, 3 Drawing Sheets

GUITAR NECK ASSEMBLY

BACKGROUND

1. Field of the Invention

The present application relates to a stringed instrument, and more particularly to a stringed neck assembly adapted for use with interchangeable sound bodies to produce custom and unique sounds with respect to both amplitude and frequency.

2. Description of Related Art

Acoustic stringed instruments, such as guitars, generally have a hollow body with strings that extend longitudinally from the top end, e.g., the headstock, to some point near on at the bottom end, e.g., the bridge or tail block, of the instrument. Between the ends of the strings lies a bridge coupled to the hollow body and that maintains the strings a certain distance above the soundboard of the stringed instrument. When the strings of the instrument are manipulated, the vibration created in the strings is transferred to the soundboard to amplify the sound of the strings. Acoustic string instruments, however, are limited with regard to the loudness that may be produced and the frequency and/or the amplitude of the sound produced without electronic amplification/enhancement. The sound box of a guitar is generally defined by the shape of the guitar's base. In prior art guitars, their bases generally vary in width along their length with a conventional guitar's base being widest across its outer end portion. There is a need for a method to increase the loudness and vary the frequency and/or the amplitude of the sound produced from an acoustic string instrument without electronic amplification/enhancement.

Although strides have been made to provide improved sound from a stringed instrument, shortcomings remain. It is desired that a neck assembly be provided that is configured to utilize custom interchangeable sound boxes to permit for the modification of sound from a plurality of strings.

SUMMARY OF THE INVENTION

It is an object of the present application to provide a neck assembly having a neck body with a top portion and a tail portion. A finger board is located adjacent the top portion along with a head. A plurality of strings are run from the head at the top portion to the tail portion where they are anchored to the neck body. A bridge is nestled partially below the finger board and apart from the anchors of the strings so as to rest directly on a hollowed body. The hollow body and the bridge rest on top of the neck body and are made of a material of suitable strength and sound/acoustic properties to support the axial and lateral tension forces of the plurality of strings spanning from the top portion of the neck body to the tail portion of the neck body.

In one embodiment the hollow body also rests within the neck body below the sound board. The hollow body is separated from the neck body by one or more spacers. The neck body wraps underneath the hollowed body so as to be both above and below the hollowed body. In other embodiments, the hollowed body may contact the neck body. In a further embodiment the finger board may includes frets.

It is a further object of the present application that the neck assembly is configured to be scaled in size to facilitate operation with various sized and types of stringed instruments.

Furthermore, an object of the present neck assembly is to permit the plurality of strings to be anchored to the neck body with anchor members. The bridge and the anchor members are isolated from one another and are coupled to different parts of the neck assembly. The neck body supports the axial tension forces of the plurality of strings at both the top portion and the tail portion thereby isolating or removing these forces from the hollow body and the bridge. The bridge and hollow body are held against the neck body by the forces exerted upon them by the plurality of strings.

A further object of the present application is to provide a hollow body capable of serving as an attachment device for the acceptance of one or more acoustic bodies. The hollow body may have an opening on either side of the neck body. An acoustic body may be coupled to one or more of the openings. Each acoustic body may be made from a unique or different material having particular acoustic properties, such that when combined with a particular shape and routing, it may provide enhancements to any one of amplification, sound quality, and frequency stemming from the string vibrations.

Ultimately the invention may take many embodiments but features the ability to accommodate the interchanging of multiple acoustic bodies with its own hollow body to modify and enhance sound frequency. This permits a user the ability to tailor the design and function of the hollow body for a superior acoustic performance. In this way, this assembly overcomes the disadvantages inherent in the prior art.

The more important features of the assembly have thus been outlined in order that the more detailed description that follows may be better understood and to ensure that the present contribution to the art is appreciated. Additional features of the assembly will be described hereinafter and will form the subject matter of the claims that follow.

Many objects of the present assembly will appear from the following description and appended claims, reference being made to the accompanying drawings forming a part of this specification wherein like reference characters designate corresponding parts in the several views.

Before explaining at least one embodiment of the assembly in detail, it is to be understood that the assembly is not limited in its application to the details of construction and the arrangements of the components set forth in the following description or illustrated in the drawings. The assembly is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and assemblies for carrying out the various purposes of the present assembly. It is important, therefore, that the claims be regarded as including such equivalent constructions insofar as they do not depart from the spirit and scope of the present assembly.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
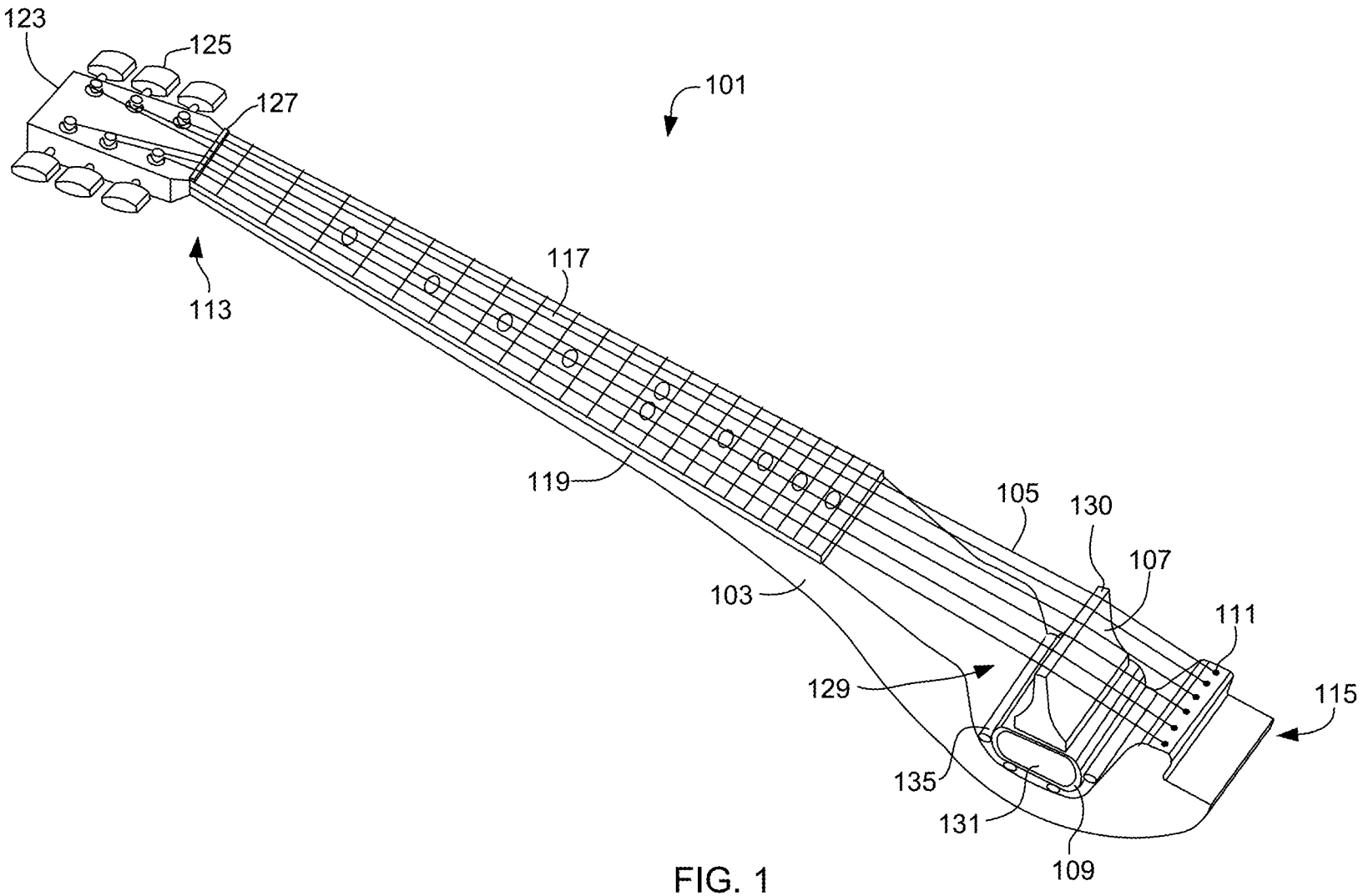
FIG. 1 is a perspective view of a neck assembly according to an embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with assembly-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the assembly described herein may be oriented in any desired direction.

The assembly and method in accordance with the present application overcomes one or more of the above-discussed problems commonly associated with elevated platforms discussed previously. In particular, the neck assembly is configured to provide a suitable platform for the customization of sound produced via a plurality of strings. The assembly is configured to permit the interchanging of acoustic bodies with a hollow body coupled to a neck body. The neck body fully supports the strings at both ends of the neck body. These and other unique features of the assembly are discussed below and illustrated in the accompanying drawings.

The assembly and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The assembly and method of the present application is illustrated in the associated drawings. The neck assembly includes a neck body with a top portion and a tail portion. A finger board is located adjacent the top portion. A plurality of strings are strung the length of the neck body extending from a head at the top portion and coupled to the bottom end of the neck body at the tail portion. The assembly includes a bridge and a hollowed body. Both are separate from the anchors of the plurality of strings. The bridge is nestled below the finger board and rests directly on the hollowed body. In other words, the hollow body and the bridge rest on top of the neck body and are made of a material of suitable strength and sound/acoustic properties to support the lateral tension forces of the plurality of strings spanning from the top portion of the neck body to the tail portion of the neck body. Additional features and functions of the assembly are illustrated and discussed below.

Referring now to the Figures wherein like reference characters identify corresponding or similar elements in form and function throughout the several views. The following Figures describe the assembly of the present application and its associated features. With reference now to the Figures, an embodiment of the neck assembly and method of use are herein described. It should be noted that the articles "a", "an", and "the", as used in this specification, include plural referents unless the content clearly dictates otherwise.

Figure 2:
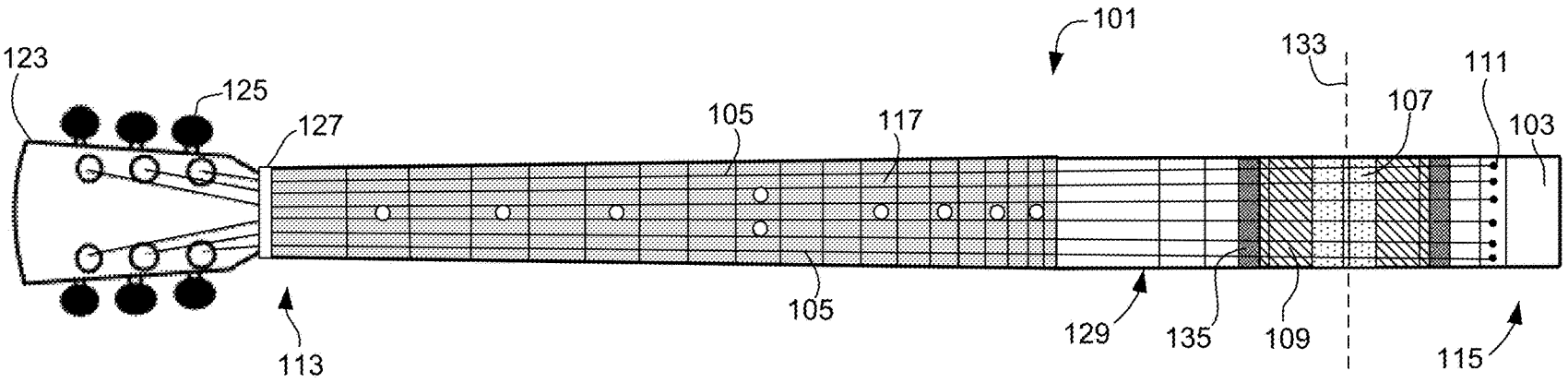
FIG. 2 is a top view of the neck assembly of FIG. 1.
Figure 3:
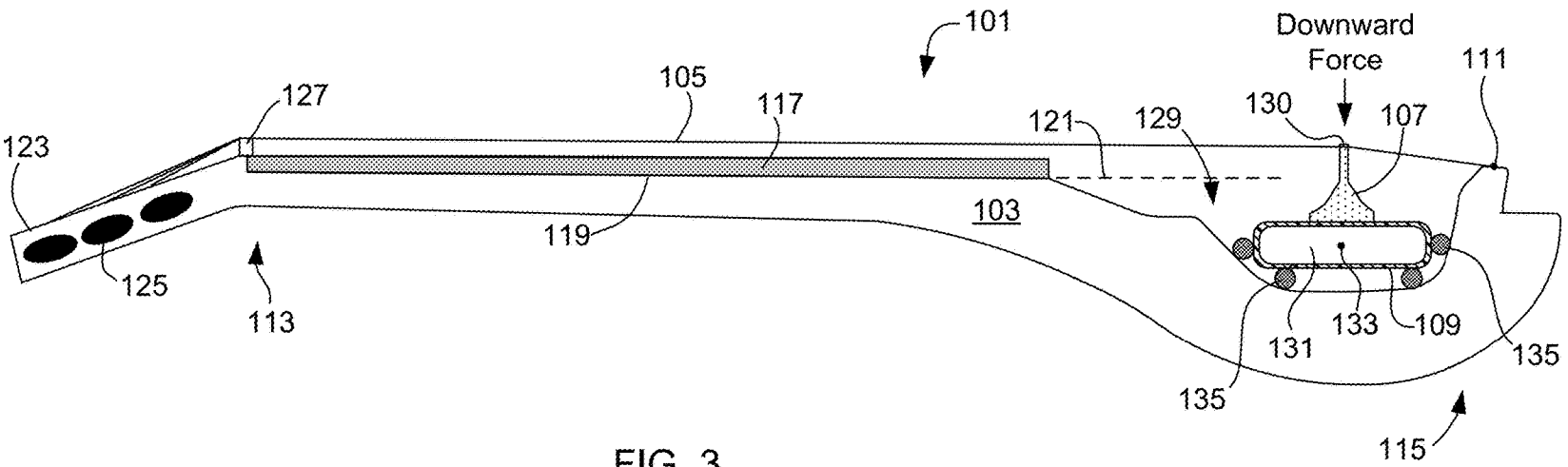
FIG. 3 is a side view of the neck assembly of FIG. 1.

Referring now to FIGS. 1-3 in the drawings, a perspective view and corresponding side and top views of a neck assembly 101 is illustrated. Neck assembly 101 is a musical instrument that is configured to permit a user to adapt and enhance sound characteristics produced through a plurality of strings by allowing for the customization of an acoustic body that is releasably coupled to the neck assembly.

The neck assembly 101 includes a neck body 103, a plurality of strings 105, a bridge 107, a hollow body 109, and an anchor member 111. Neck body 103 includes a top portion 113 and a tail portion 115. Neck body 103 is made of a material of sufficient strength and acceptable acoustic properties to support the axial and lateral tension forces of strings 105. An exemplary material would be that of wood. Neck body 103 includes a finger board 117 adjacent top portion 113. Finger board 117 is coupled to an upper surface 119 of neck body 103 adjacent top portion 113. Surface 119 defines a plane 121. Neck body 103 has a general tapered width along its length extending from top portion 113 to tail portion 115. The degree of taper found with neck body 103 is more pronounced along finger board 117. The taper may be removed near tail portion 115 wherein the sides of neck body 103 are relatively parallel.

At top portion 113, neck assembly 101 further includes a head 123 having one or more mechanical tuners 125 for the tensioning of strings 105. A nut 127 is also included with head 123. Nut 127 is immediately next to the head for arraying strings 105 at the top portion 113 of neck body 103 across the width of said neck. Finger board 117 is made of an acceptable material of the right acoustic and mechanical properties, with or without frets, that extends from nut 127 down the length of neck body 103 along plane 121, stopping just before a recess 129 in the neck body 103. Recess 129 is a void space within neck body 103 where surface 119 drops below plane 121. Typically recess 129 begins at or immediately following finger board 117 and extends to the other side of bridge 107 and hollow body 109.

Strings 105 are strung the length of neck body 103 and are arrayed across the width of nut 127 and bridge 107. Strings 105 extend from head 123 and are coupled to tail portion 115 opposite recess 129. Assembly 101 includes one or more anchor members coupled to neck body 103 and configured to secure the plurality of strings 105 to tail portion 115. Nut 127 and bridge 107 are configured to position and index the plurality of strings 105 along their length.

The assembly includes bridge 107 and hollowed body 109. Both are separate/isolated from the anchor members 111 used to secure the plurality of strings 105. Anchor members 111 are wholly above plane 121, although it is understood that other embodiments may locate members 111 below plane 121 outside of recess 129. As noted above, bridge 107 is in communication with strings 105 and accepts downward tensioned forces and lateral forces from the strings. These forces help or aid in the securing of bridge 107 and hollow body 109 within recess 129. These forces help to hold bridge 107 and hollow body 109 against surface 119 in a proper indexed/oriented position within recess 129.

Strings 105 are arrayed across top surface 130 in a manner similar to that seen with nut 127. As seen in the Figures, bridge 107 is nestled at least partially below plane 121 within recess 129. Bridge 107 also rests directly on the hollowed body 109, such that hollow body 109 is wholly below plane 121. In other words, hollow body 109 and the bridge 107 rest in communication with surface 119 within recess 129. Each is made of a material of suitable strength and sound/acoustic properties to support the lateral tension forces of the plurality of strings 105 spanning recess 129 from the top portion 113 of the neck body to the tail portion 115 of the neck body. The axial tension forces are supported by neck body 103.

Hollow body 109 is of a generally tubular shape and of sufficient length to achieve a desired acoustic response. Body 109 is most similar to a sleeve having a minimum of two open ends 131 with an equal, reduced or varying cross-sectional area between the open ends 131. Open ends 131 define a plane relatively parallel with the length of neck body 103. Another way of locating the orientation of hollow body 109 is that a central axis 133 of hollow body 109 is transverse to the length of neck body 103. Hollow body 109 is sized such that open ends 131 are generally within the confines of the outer perimeter of neck body 103. In operation, hollow body 109 is used to convert vibrating string energy generated from plucking, strumming, or playing strings 105. This vibrating string energy is converted into acoustic energy by means of bridge 107. Bridge 107 is stacked upon hollow body 109 and located between open ends 131 such that the vibrating string energy passes from strings 105, through bridge 107 and into the walls of hollow body 109. Hollow body 109 can be made of any material of sufficient strength and acceptable acoustic properties such that it will support bridge 107 and the lateral forces of tensioned strings 105 while producing acceptable acoustic results.

In some embodiments, it is desired that a box or casing similar to standard guitars or other instruments be included to provide an aesthetic look and to modify the sound quality and characteristics. Such casing, if used, shall be fixed to neck body 103 and hollow body 109 as needed to index and secure all components. If no outer casing is used then a suitable array of connections shall be established between hollow body 109 and neck body 103 to index and secure the two to each other.

Assembly 101 may also further include one or more spacers configured to stabilize hollow body 109 with respect to neck body 103. Additionally, these spacers 135 act to insulate vibrations or energy resonating back into neck body 103. One or more spacers 135 may be used and can be made from any suitable insulative material. It is desired that such material be relatively hardened to prevent undesired flexure of the hollowed body 109. As seen in the Figures, spacers 135 contact hollow body 109 and surface 119 within recess 129.

Figure 4:
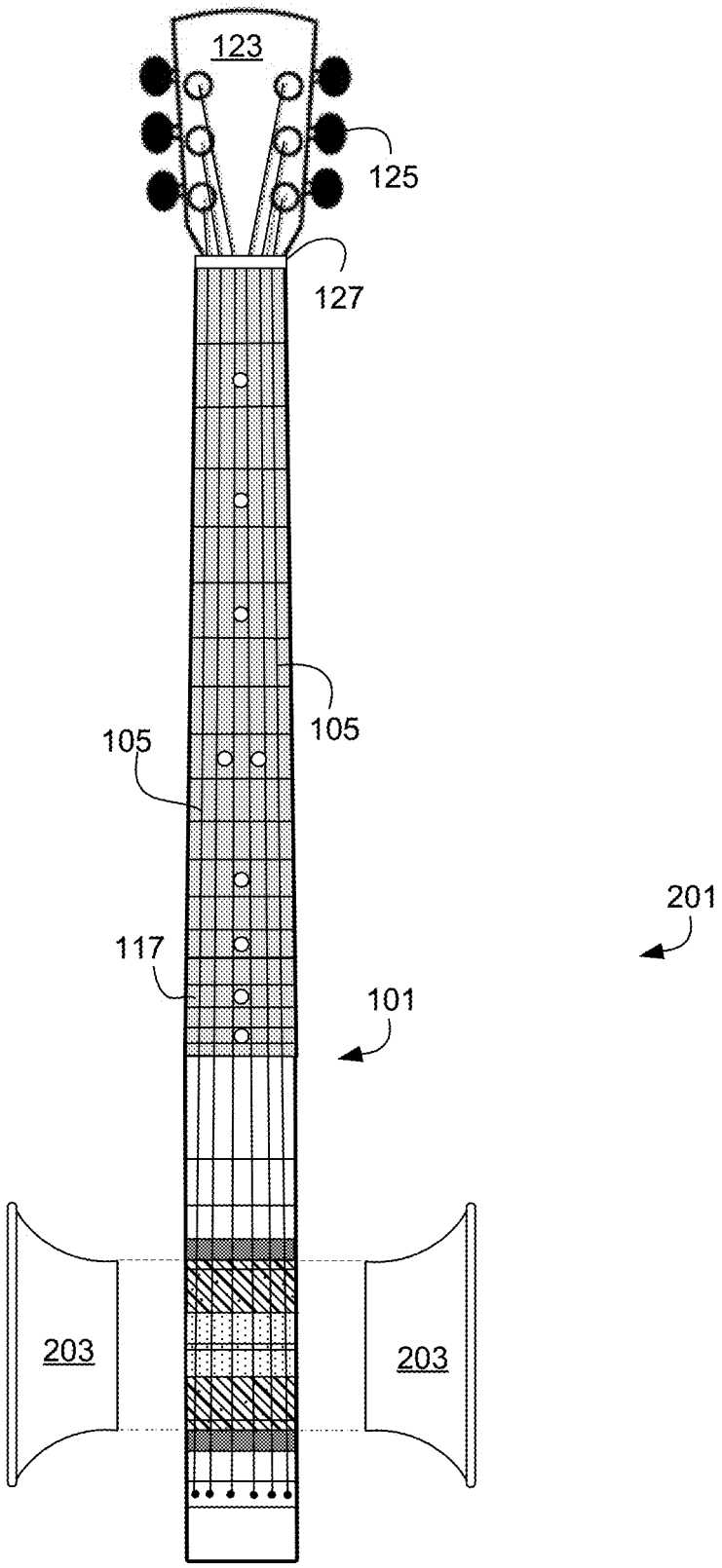
FIG. 4 is a top view of an alternate embodiment of the neck assembly of FIG. 1, with an acoustic body.

Referring now also to FIG. 4 in the drawings, an alternative embodiment of assembly 101 is illustrated. Neck assembly 201 is similar in form and function to that of assembly 101 except as herein noted. Assembly 201 is illustrated from a top view similar to FIG. 2. The difference being that assembly 201 includes an acoustic body in releasable communication with open ends 131 of hollowed body 109. As noted above, an additional casing may be located in communication with assembly 101. Acoustic bodies 203 may be included with or without the use of an external casing. Acoustic body 203 is configured to enhance at least one of the frequency, amplification, and sound quality of the sound produced from the plurality of strings as resonated through hollow body 109. Acoustic body 203 is configured to communicate with one or more open ends 131 and provide a routing that funnels or channels the sound out and away from neck body 103. This permits that acoustic body 203 may have any shape and contour, following any path conceivable. A user may detach one set of acoustic bodies 203 and reattach another set having different physical characteristics, such as material, length, routing, size, and so forth in an effort to adjust the sound produced through strings 105.

It is understood then that hollow body 109 may be made from similar or dissimilar materials from acoustic body 203. It is also understood that acoustic body 203 is potentially designed to emulate sound produced through other stringed instruments, thereby making a single assembly and set of strings capable of producing a vastly wider array of sounds, frequencies, and amplifications. Though hollow body 109 functions the same (i.e. acoustically amplifying string vibration) the result is an ability to tailor the design and function of hollow body 109 for a superior acoustic performance both with and without the aid of acoustic body 203.

The current application has many advantages over the prior art including at least the following: (1) neck body supporting axial forces of the strings independent of the hollow body and the bridge; (2) the anchor members are located remote from the bridge; and (3) ability to alter and enhance the sound produced from the strings by selecting and locating an acoustic body onto the hollow body.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A musical instrument neck assembly for a stringed instrument, comprising:

a neck body having a top portion and a tail portion;

a plurality of strings coupled to the neck body and extending between the top portion and the tail portion;

an anchor member configured to secure the plurality of strings to the tail portion of the neck body;

a bridge in contact with the plurality of strings, the plurality of strings arrayed over a top surface of the bridge, the bridge being isolated from the anchor member; and a hollowed body in contact with and below the bridge, the hollowed body is configured to have one or more open ends, the hollowed body located between the top portion and the tail portion and being separated from contact with the neck body, the one or more open ends opening to a side of the neck body.

2. The assembly of claim 1, wherein sound is produced in the hollowed body through the passage of vibrating string energy vibrations from the bridge to a surface of the hollowed body.

3. The assembly of claim 1, wherein the neck body includes an upper surface defining a plane, the hollowed body located below the plane.

4. The assembly of claim 1, wherein the hollowed body and bridge are nestled at least partially below an upper plane of the neck body.

5. The assembly of claim 1, wherein the hollowed body defines a central axis that is transverse to the length of the neck body.

6. The assembly of claim 1, further comprising:

an acoustic body configured to releasably coupled to the one or more open ends of the hollowed body, the acoustic body configured to enhance at least one of the frequency, amplification, an sound quality of the sound produced from the plurality of strings.

7. The assembly of claim 6, wherein the acoustic body is made of a different material than the hollowed body.

8. The assembly of claim 6, wherein the acoustic body is configured to emulate the sound of other stringed instruments.

9. The assembly of claim 1, further comprising:

a spacer configured to separate the hollowed body from the neck body.

10. The assembly of claim 1, wherein the bridge is in direct contact with the hollowed body.

11. The assembly of claim 1, further comprising:

a fingerboard adjacent the top portion of the neck body.

12. The assembly of claim 1, further comprising:

a head coupled to the neck body at the top portion, the head having one or more tuners for the adjustment of tension on the plurality of strings.

13. The assembly of claim 1, wherein a width of the hollowed body remains within the perimeter of the neck body.

14. A musical instrument neck assembly for a stringed instrument, comprising:

a neck body having a top portion and a tail portion;

a plurality of strings coupled to the neck body and extending between the top portion and the tail portion;

an anchor member configured to secure the plurality of strings to the tail portion of the neck body;

a bridge in contact with the plurality of strings, the plurality of strings arrayed over a top surface of the bridge, the bridge being isolated from the anchor member; and a hollowed body in contact with a lower surface of the bridge and configured to have one or more open ends, the hollowed body being located within a recess of the neck body, between the top portion and the tail portion, the one or more open ends defining an axis transverse to a length of the neck body, the one or more open ends opening to a side of the neck body.

15. The assembly of claim 14, further comprising:

a spacer used to separate the hollowed body from the neck body;

a fingerboard adjacent the top portion of the neck body; and a head coupled to the neck body at the top portion, the head having one or more tuners for the adjustment of tension on the plurality of strings.

16. A method generating sound, comprising:

providing an instrument having a plurality of strings, the instrument having:

a neck body with a top portion and a tail portion defining a length;

a plurality of strings coupled to the neck body and extending between the top portion and the tail portion;

an anchor member configured to secure the plurality of strings to the tail portion of the neck body;

a bridge in contact with the plurality of strings, the plurality of strings arrayed over a top surface of the bridge, the bridge being isolated from the anchor member; and a hollowed body in contact with a lower surface of the bridge and configured to have one or more open ends defining an axis transverse to the length of the neck body, the one or more open ends opening to a side of the neck body;

coupling a releasable acoustic body to at least one of the one or more open ends; and modifying the sound produced through the plurality of strings by interchanging the acoustic body.

17. The method of claim 16, further comprising:

applying a spacer used to separate the hollowed body from the neck body.

18. The method of claim 16, further comprising:

placing the bridge in direct contact with the hollowed body so as to pass resonating sound wave vibrations from the bridge to a surface of the hollowed body.

* * * * *